US009932754B2

(12) United States Patent
Schlatter

(10) Patent No.: US 9,932,754 B2
(45) Date of Patent: Apr. 3, 2018

(54) CABLE TENSIONING SYSTEM AND METHOD

(71) Applicant: Daniel J. Schlatter, Warsaw, IN (US)

(72) Inventor: Daniel J. Schlatter, Warsaw, IN (US)

( * ) Notice: Subject to any disclaimer, the term of this patent is extended or adjusted under 35 U.S.C. 154(b) by 0 days.

(21) Appl. No.: 15/148,473

(22) Filed: May 6, 2016

(65) Prior Publication Data

US 2016/0326768 A1 Nov. 10, 2016

Related U.S. Application Data

(60) Provisional application No. 62/179,382, filed on May 7, 2015.

(51) Int. Cl.
*E04H 17/06* (2006.01)
*E04H 17/26* (2006.01)
*E04F 11/18* (2006.01)

(52) U.S. Cl.
CPC ..... *E04H 17/266* (2013.01); *E04F 11/1859* (2013.01); *E04H 17/06* (2013.01)

(58) Field of Classification Search
CPC ..... E04F 11/1859; E04F 11/1885; E04F 2011/1885; E04H 17/04; E04H 17/06; E04H 17/10; E04H 17/12; E04H 17/26; E04H 17/266
USPC ..... 256/32, 37
See application file for complete search history.

(56) References Cited

U.S. PATENT DOCUMENTS 349,985 A * 9/1886 De Witt ..... E04H 17/266 256/42
606,873 A * 7/1898 Matthews ..... E04H 17/266 256/36
607,410 A * 7/1898 Flanagan et al. ..... E04H 17/08 256/37
680,438 A * 8/1901 Pierce ..... E04H 17/08 256/37
1,985,878 A * 1/1935 Aubol ..... F16G 11/12 256/37
3,661,360 A * 5/1972 Windham ..... E04F 11/18 256/37
3,990,665 A * 11/1976 Joussemet ..... A47B 43/006 108/149
6,053,480 A 4/2000 De Guise
6,135,424 A 10/2000 Bracke
6,568,658 B2 5/2003 Strome
6,679,480 B1 * 1/2004 Hara ..... E04H 17/10 256/37
7,198,253 B2 * 4/2007 Striebel ..... E04F 11/1834 254/231

(Continued)

FOREIGN PATENT DOCUMENTS

FR 3000531 A1 * 7/2014 ..... E04F 11/1859

OTHER PUBLICATIONS

Design of Machine Elements. Babu, et al. New Delhi, India: Tata McGraw Hill Education Private Limited, 2009. p. 131. ISBN: 9780070672840.*

(Continued)

*Primary Examiner* — Josh Skroupa

(74) *Attorney, Agent, or Firm* — Faegre Baker Daniels LLP

(57) ABSTRACT

A system and method for tensioning cables for use in railings includes anchor bodies positioned in posts to receive terminal ends of cables and tensioner members that apply force to the terminal ends of the cables.

19 Claims, 4 Drawing Sheets

(56) References Cited

U.S. PATENT DOCUMENTS

| | | | | |
|---|---|---|---|---|
| 9,249,577 | B2 * | 2/2016 | Ross | E04F 11/1859 |
| 2005/0207838 | A1 | 9/2005 | Striebel | |
| 2006/0196053 | A1 | 9/2006 | Pratt | |
| 2011/0140063 | A1 | 6/2011 | Sandor, Sr. | |
| 2012/0168703 | A1 * | 7/2012 | Napier | E04F 11/1842 256/37 |
| 2014/0008597 | A1 | 1/2014 | Herman | |
| 2014/0138596 | A1 | 5/2014 | Ross | |
| 2014/0299829 | A1 | 10/2014 | Herman | |
| 2015/0021533 | A1 * | 1/2015 | Johnson | E04H 17/266 256/37 |

OTHER PUBLICATIONS

Feeney, CableRail Composite Solutions, Webpage, Nov. 10, 2012, http://www.feeneyinc.com/CableRail.

Atlantis Rail Systems, Cable Railing, Webpage, May 16, 2009, http://www.atlantisrail.com/cable-railing.

Feeney, Step-by-Step Solutions, PDF, 2017.

Atlantis Rail Systems, Design Parameters Rail Easy Cable Railing, PDF.

Atlantis Rail Systems, Rail Easy Nautilus Installation Instructions, PDF, 2015, 1-7.

Feeney, Quick-Connect fittings make cable projects quicker and easier than ever, Webpage, Nov. 10, 2012, http://www.feeneyinc.com/Architectural/CableRail-Standard-Assemblies#prod_info.

* cited by examiner

CABLE TENSIONING SYSTEM AND METHOD

CROSS-REFERENCE TO RELATED APPLICATION

The present application claims priority to U.S. Provisional Patent Application Ser. No. 62/179,382, titled "PARALLEL SCREW CABLE TENSIONING DEVICE," to Daniel Jay Schlatter, filed May 7, 2015, the complete disclosure of which is expressly incorporated by reference herein.

BACKGROUND OF THE DISCLOSURE

Cable railings are a used on interior and exterior walkways and staircases to create barriers. Many cable railings use metal cable strung under tension between and/or through posts to create such a barrier. Cable railings may be used with metal, wood, and other posts.

Cable railings use a variety of methods to install and tension the cable between terminal posts and through intermediate posts.

SUMMARY OF THE DISCLOSURE

The present disclosure relates to methods, systems, and devices for producing and installing cable rail systems which utilize internal tensioning systems. In some embodiments, a cable rail system comprises a cable tensioning device. Within this cable tensioning device an off-center set screw positioned in a cable tensioning body applies tension to a cable using a sleeve crimped to one end of the cable and an offset lobe positioned between the set screw and the crimped sleeve to tension and secure a cable between two terminal posts. In some embodiments, the cable tensioning body is located on terminal ends of each cable and placed within terminal posts of the railing. In some embodiments, a cable rail is routed between two terminal posts and through holes drilled through one or more intermediate posts, which hold do not tension the cable rail. In some embodiments, caps with a substantially similar external profile to the cable tensioning body are used to cover the holes drilled through intermediate posts through which the cable rail is routed.

According to another aspect of the present disclosure, a method for installing a cable rail system is provided that comprises drilling a guide hole into a terminal post, using a tensioning body bit to drive a tensioning body into the guide hole in the terminal post, placing a lobe on a cable, crimping a sleeve to an end of the cable rail, inserting the cable into the tensioning body, and using a set screw to apply force to the lobe and tension to the cable rail.

Additional features of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The aforementioned aspects and many of the intended features of this disclosure will grow to be appreciated at a greater level once references to the following accompanying illustrations are expounded upon.

Figure 1:
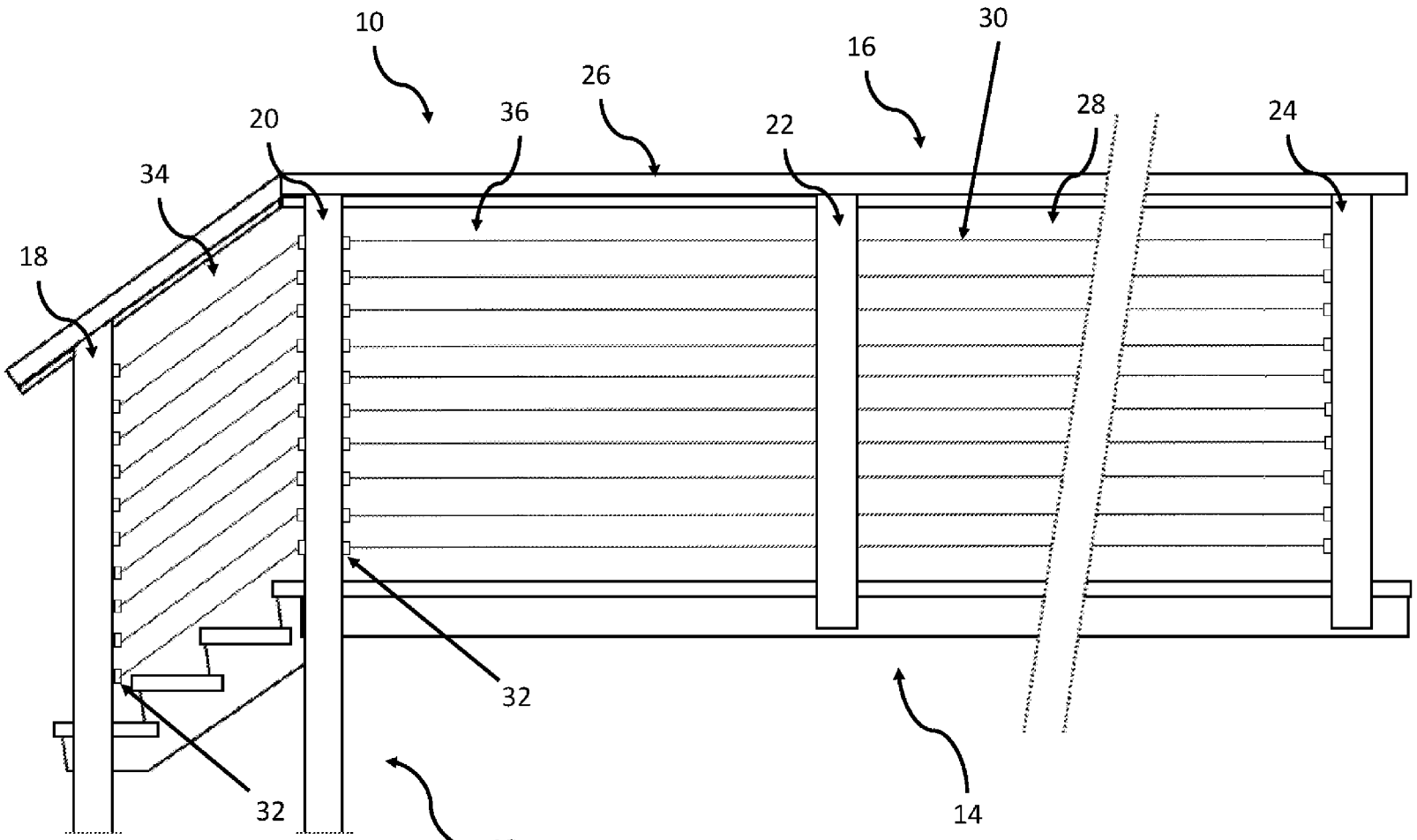
FIG. 1 is a side elevation view of a rail installed on a deck having a set of stairs and a platform showing the rail including a plurality of posts and cable extending between the posts to form a barrier.

For the purposes of promoting an understanding of the principals of the disclosure, reference will now be made to the embodiments illustrated in the drawings, which are described below. Unless otherwise indicated, the components shown in the drawing are proportional to each other. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

DETAILED DESCRIPTION OF THE DRAWINGS

Referring to FIG. 1, a deck 10 is shown having a set of steps 12 and a platform 14. Deck 10 is provided with a railing 16 having a first end post 18, a second end post 20, a first intermediate post 22 positioned at the top of stairs 12, a second intermediate post 24, an upper rail 26 extending on top of posts 18, 20, 22, 24, and a cable system 28 extending between first end post 18 and second end post 20. Cable system 28 includes a plurality of cables 30 extending between posts 18, 20, 22, 24 and cable tensioners 32 that secure cables 30 to posts 18, 20, 24 and apply tension to cables 30.

As shown in FIG. 1, a first set 34 of cables 30 extend partially into first end post 18 and partially into first intermediate post 22 and are angled to match the incline of steps 12 and upper rail 26 positioned over steps 12. A second set 36 of cables 30 extend partially into first intermediate post 22, completely through second intermediate post 24, and partially into second end post 20. Normally, cable tensioners 32 are provided on the ends of cables 30 to apply tension to cables 30. Cables 30 are normally terminated at the end of railings 16 or at transitions in the direction of cables 30, such as at first intermediate post 22 where steps 12 meet platform 14, a corner post (not shown) of a platform, or other locations where cables 30 are not straight. Deck 10 is merely an example railing and deck. Cable system 28 may be used on other railing configurations or other situations that may benefit from tensioned cables.

Figure 2:
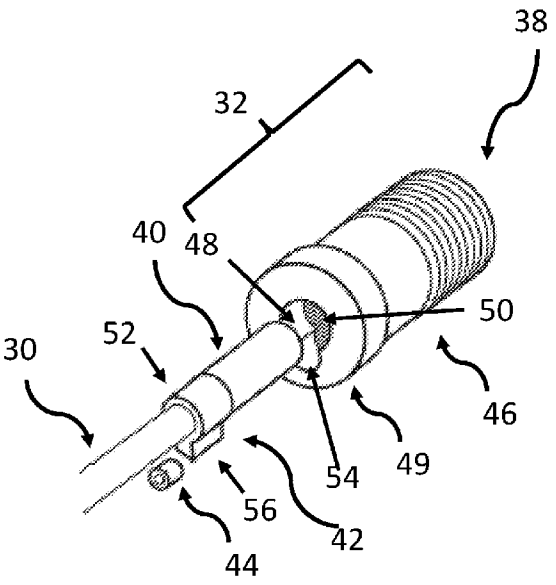
FIG. 2 is an assembly view of a cable tensioning system used to tension the cable showing the system including a substantially cylindrical tensioning body having a bore there through, a sleeve crimped to an end of the cable and aligned with the bore, a lobe positioned over the cable, and a set screw aligned with an extension of the lobe and a lower portion of the bore.
Figure 3:
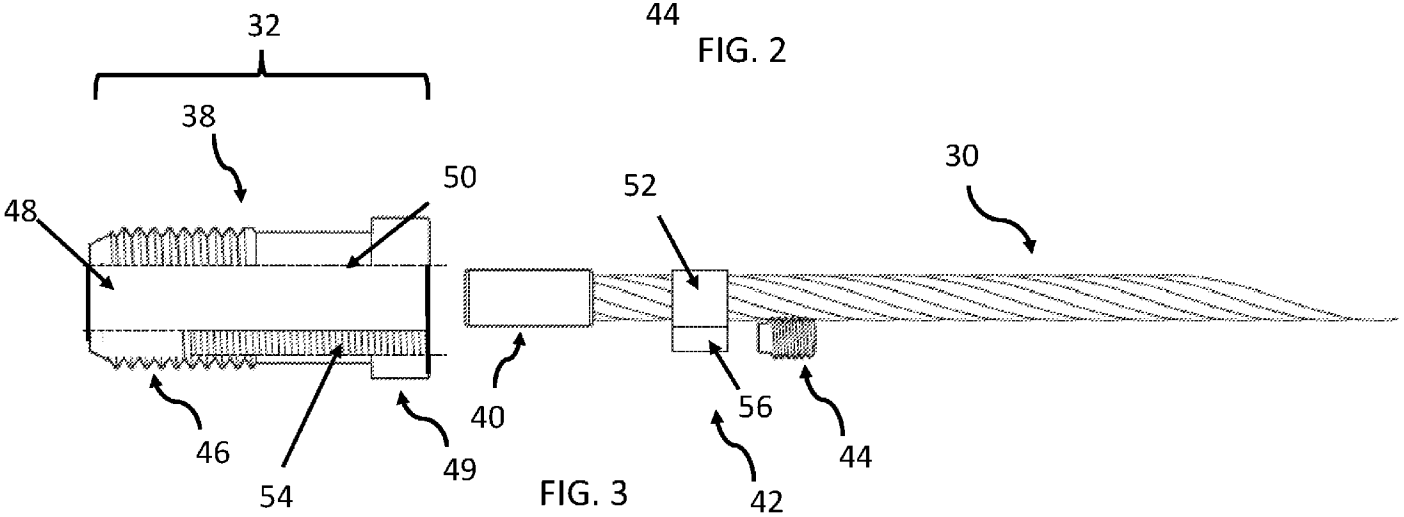
FIG. 3 is a side elevation view of the cable tensioning system of FIG. 2 showing the set screw aligned with the extension of the lobe and the threaded lower portion of the bore.
Figure 4:
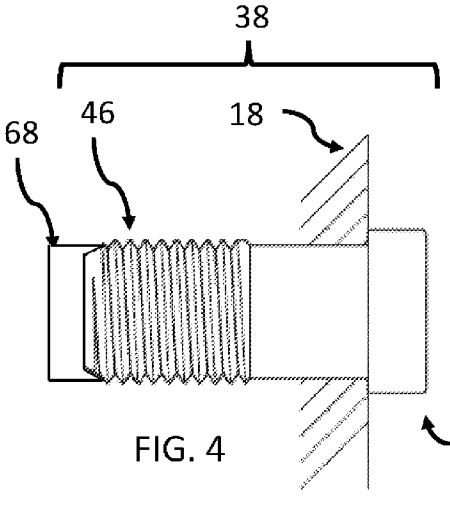
FIG. 4 is a side elevation view of the tensioning body positioned in a post.
Figure 5:
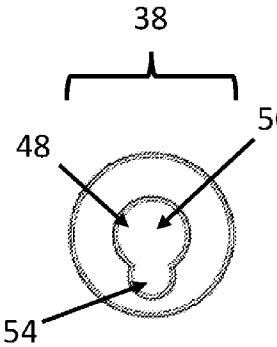
FIG. 5 is an end view of the tensioning body showing the bore having a upper portion sized to receive the cable and the lower threaded portion sized to receive the extension of the lobe and the set screw.
Figure 6:
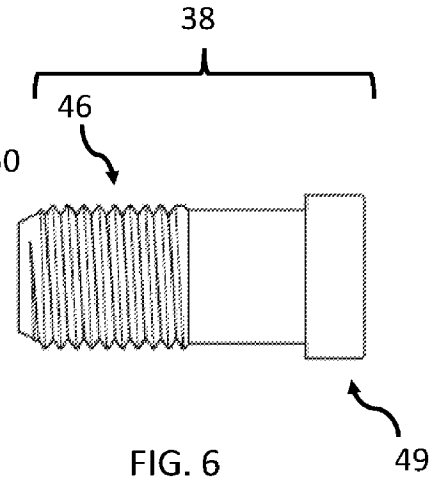
FIG. 6 is a view similar to FIG. 4 showing the tensioning body positioned away from a post.
Figure 8:
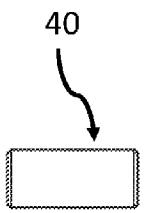
FIG. 8 is an side view of the sleeve of FIG. 7.
Figure 7:
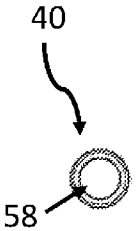
FIG. 7 is an end view of the sleeve before being crimped to an end of a cable.
Figure 9:
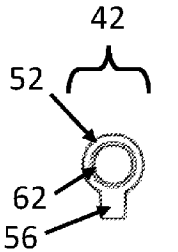
FIG. 9 is an end view of the lobe showing the lobe having a sleeve with a bore side to receive the cable and the extension.
Figure 10:
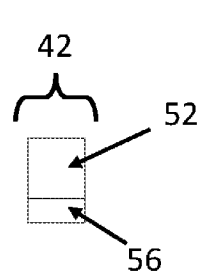
FIG. 10 is a side view of the lobe.
Figure 11:
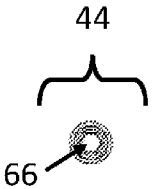
FIG. 11 is an end view of the set screw.
Figure 12:
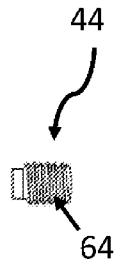
FIG. 12 is a side view of the set screw of FIG. 11.

As shown in FIGS. 2 and 3, cable tensioner 32 includes a tensioner body 38, a sleeve 40, a lobe 42, and a set screw 44. Tensioner body 38 and set screw 44 may be made of stainless steel or any other suitable material and sleeve 40 and lobe 42 may be made of aluminum or any other suitable material. As shown in FIGS. 2-6, tensioner body 38 includes a partially threaded cylinder 46 and a collar 49. Tensioner body 38 includes a bore 48 having a cable portion 50 sized to receive sleeve 40, a cable portion 52 of lobe 42, and cable 30 and tensioning portion 54 sized to receive an extension 56 of lobe 42 and set screw 44. In one example of the present disclosure, cable portion 50 is substantially cylindrical and smooth and tensioning portion 54 is threaded to mate with set screw 44.

As shown in FIGS. 2, 3, 7 and 8, sleeve 40 is substantially cylindrical and has a bore 58 sized to receive cable 30. As shown in FIGS. 2, 3, 9, and 10, lobe 42 includes substantially cylindrical cable portion 52 having a bore 62 sized to receive cable 30 and extension 56. As shown in FIGS. 2, 3, 11, and 12, set screw 44 has external threads 64 and a hexagonal aperture 66 sized to receive an Allen wrench or bit.

The installation of cables 30 is described herein. The specific order of installation does not need to follow the order described herein. To install cables 30 in posts 18, 20, 22, and 24, cables 30 are cut to a length about the distance between the end posts through which cables 30 will extend plus the width of a post. For example, cables 30 of first cable set 34 are cut to the angled distance between posts 18, 20 plus the width of one of posts 18, 20 and cables 30 for second cable set 36 are cut to the distance between post 20 and post 24 plus the width of one of posts 20, 24. Next, holes 68 are drilled into posts 18, 20, and 24 to receive cable tensioners 32 holes 70 are drilled into post 22 for only cable 30. Holes 68 are about the diameter of the unthreaded portion of partially threaded cylinder 46 of tensioner bodies 38 and preferably only extend partially through the respective end posts. Holes 70 are slightly larger than the diameter of cable 30 and extend all the way through the respective posts.

Figure 16:
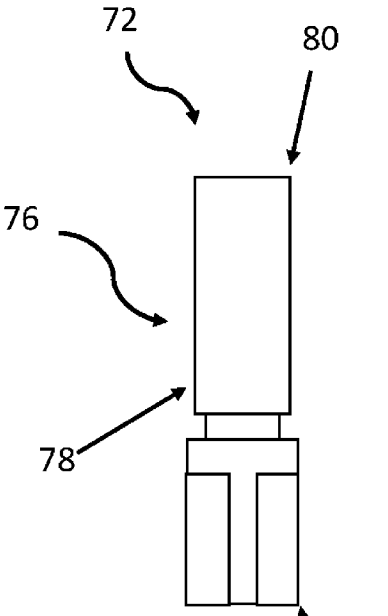
FIG. 16 is a side elevation view of a bit used to drive the tensioning body and the caps into posts.

After holes 68 are drilled, tensioner bodies 38 are driven into respective holes 68 with a tensioner body bit 72 shown in FIG. 16. Bit 72 includes a hexagonal shank 74 to be received by a hand drill (not shown) and a driver 76 sized to fit within bore 48 of tensioner body 38 including a center portion 78 sized to fit in cable portion 50 and a lug 80 sized to fit in tensioning portion 54. During driving, lug 80 engages tensioner body 38 to turn tensioning body 38. The threads of cylinder 46 pull tensioner body 38 into the post and maintain the position of tensioner body therein. Preferably, a tensioner body 38 is driven into a post until collar 49 is flush with the outer surface of the post.

When a cable 30 is installed at an angle other than 90 degrees from a post, it is preferable that tensioning portion 54 of bore 48 be positioned is a location providing the most access to tensioning portion 54 to facilitate the insertion and driving of set screw 44 into tensioning portion 54. For example, in FIG. 1 for post 18, tensioning portions 54 of bore 48 of respective tensioner bodies 38 are preferably positioned directly under where cables 30 are to be installed. On the left side of post 20, tensioning portions 54 of bore 48 of respective tensioner bodies 38 are positioned directly above where cables 30 are to be installed.

Before or after holes 68, 70 are drilled and tensioner bodies 38 installed into posts 18, 20, 22, 24, a lobe 42 is positioned over the ends of cables 30 and slid partially down cables 30. Next, a sleeve 40 is positioned over the ends of cables 30 and crimped to firmly secure sleeves 40 to the respective ends of cables 30, which blocks lobes 42 from being removed from cables 30. Before or after lobes 42 and sleeves 40 are positioned on cables 30, cables 30 are extended through any intermediate posts.

To tension cables 30, sleeve 40 and cable portion 60 of lobe 42 are positioned in cable portion 50 of bore 48 of tensioner body 38. Extension 64 is positioned in tensioning portion 54 of bore 48. Next, set screw 44 is driven into tensioning portion 54 of bore 48 with an Allen wrench or similar bit, which pushes lobe 42, sleeve 40, and cable 30 further into tensioner body 38 and applies tension to cable 30. This step is repeated at the opposite end of cable 30 to apply additional tension to cable 30. The tensioning of each end of cable 30 may also occur simultaneously so that neither end of cable 30 is completed tensioned before the other end. According to one method, cable tensioners 32 are only provided on one end of cables 30 and the opposite end is secured without a cable tensioners 32.

As the result of the tensioning of cables 30, the external threads of tensioner bodies 38, press against the material of posts 18, 20, 24. Thus, the retaining force applied by tensioner bodies 38 is substantially internal to posts 18, 20, 24. Furthermore, the retaining force applied by the tensioner bodies 38 is generally on the side of posts 18, 20, 24 closest to the cables 30.

Figure 13:
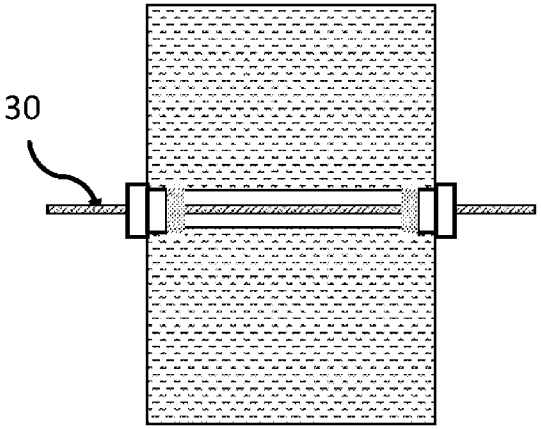
FIG. 13 is a cross-sectional view taken through an intermediate post showing a pair of caps positioned in a bore in the post and a cable extending through the caps and bore without tension being applied to the cable by the pair of caps.
Figure 15:
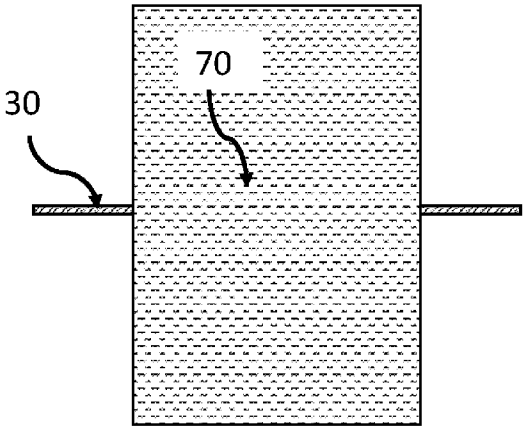
FIG. 15 is a cross-sectional view taken through another intermediate post showing a cable extending through a bore in the post.
Figure 14:
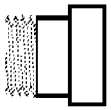
FIG. 14 is a side elevation view of one of one of the caps of FIG. 13.

According to one installation method, caps 82 (see FIGS. 13 and 14) may be provided on posts (ex. post 22) that are intermediate posts (ex. posts 20, 24) with tensioner bodies 38. Caps 82 are similar to tensioner bodies 38, but are generally shorter. Caps 82 are substantially aesthetic and apply little, if any, tension to cables 30. As shown in FIG. 15, caps 82 may not be provided on such intermediate posts.

It will be understood by one of skill in the arts that the particular geometries of the hardware depicted in this disclosure are merely a preferred embodiment and may be modified or altered within the spirit and scope of this disclosure. This application is therefore intended to cover any variations, uses, or adaptations of the disclosure using its general principles. Further, this application is intended to cover such departures from the present disclosure as come within known or customary practices in the art to which this disclosure pertains.

The invention claimed is:

1. A railing system comprising, a plurality of posts, a plurality of cables extending between the plurality of posts, each cable having first and second terminal ends, and a plurality of tensioning anchors each coupling the cables to at least one of the plurality of posts, each of the tensioning anchors including an anchor body positioned in at least one of the plurality of posts and including first and second conjoined holes only partially overlapping one another, the first conjoined hole sized to receive the first terminal end of one of the plurality of cables, and a tensioner member sized to be received in the second conjoined hole and fixed to a respective cable relative to the first terminal end, such that movement of the tensioner member within the second conjoined hole moves the first terminal end of the respective cable relative to the anchor body during tensioning of the cable.

2. The railing system of claim 1, wherein the tensioner member is positioned in the anchor body.

3. The railing system of claim 1, wherein the anchor body has a longitudinal axis that is substantially perpendicular to a face of at least one of the plurality of posts in which the anchor body is positioned.

4. The railing system of claim 1, wherein the exterior of the anchor body is threaded.

5. The railing system of claim 1, wherein the tensioner member is threaded into the anchor body.

6. The railing system of claim 1, wherein the tensioner member has a hole configured to receive a tool bit.

7. The railing system of claim 1, wherein the tensioner member comprises a lobed washer that receives the cable and is sized to be received in the first conjoined hole, and a lobe extension sized to be received in the second conjoined hole.

8. The railing system of claim 1, wherein the cable has the first terminal end positioned in the anchor body and bends at a location outside and adjacent to the anchor body.

9. The railing system of claim 1, wherein the tensioner is positioned substantially closer to the first terminal end than the second terminal end of a respective one of the plurality of cables.

10. The railing system of claim 1, wherein the first and second conjoined holes define respective longitudinal axes which are substantially parallel and offset.

11. A tensioning anchor, the tensioning anchor comprising, a cable tensioner having an axis of rotation, and an anchor body, the anchor body including a first void sized to receive a terminal end of a cable, the axis of rotation of the cable tensioner configured to be positioned parallel to and spaced away from a longitudinal axis of the cable when the terminal end of the cable is received in the void, and a second void conjoined with the first void, the second void being sized to receive the cable tensioner during tensioning of the cable, the first and second conjoined voids only partially overlapping one another.

12. The tensioning anchor of claim 11, further comprising a post, wherein the anchor body is configured to be positioned directly adjacent to the post when anchored to the post.

13. The tensioning anchor of claim 11, wherein the anchor body is capable of being screwed into a post.

14. The tensioning anchor of claim 11, wherein the tensioner member is configured to be positioned substantially closer to a first terminal end of a cable when the tensioning anchor is coupled to the cable than to a second terminal end of the cable.

15. A method for assembling a rail comprising, providing a plurality of posts, at least one cable, and a tensioning anchor, securing the tensioning anchor into a face of one of the plurality of posts, positioning a terminal end of the cable into a first bore formed in the tensioning anchor so the cable extends outwardly from the face of the post, the first bore defining a first longitudinal axis, positioning a tensioner member into a second bore formed in the tensioning anchor, the tensioner member fixed to the at least one cable, the second bore defining a second longitudinal axis offset from the first longitudinal axis, such that the first and second bores at least partially overlap one another, and advancing the tensioner member into the second bore such that the terminal end of the cable also advances relative to the tensioning anchor to tension the cable.

16. The method for assembling a rail of claim 15, wherein the step of advancing the terminal end of the cable includes moving the cable inwardly from the face of the post.

17. The method for assembling a rail of claim 15, wherein the tensioner member is fixed to the at least one cable by a step of crimping the tensioner member onto the cable.

18. The method for assembling a rail of claim 15, wherein the step of advancing the terminal end of the cable includes driving the tensioner member of the tensioning anchor into an anchor body of the tensioning anchor.

19. The method for assembling a rail of claim 15, further comprising a step of bending a portion of the cable adjacent to and outside of the tensioning anchor.

* * * * *